US005340321A

United States Patent [19]

Hashiguchi et al.

[11] Patent Number: 5,340,321

[45] Date of Patent: Aug. 23, 1994

[54] ELECTRICAL CONNECTOR WITH A SHIELDING SHELL

[75] Inventors: Osamu Hashiguchi; Hiroaki Kinoshita, both of Tokyo, Japan

[73] Assignee: Japan Aviation Electronics, Japan

[21] Appl. No.: 29,976

[22] Filed: Mar. 12, 1993

Related U.S. Application Data

[62] Division of Ser. No. 911,889, Jul. 10, 1992, abandoned.

[30] Foreign Application Priority Data

Jul. 11, 1991 [JP] Japan ..... 3-61736[U]
Aug. 6, 1991 [JP] Japan ..... 3-69252[U]

[51] Int. Cl.[5] ..... H01R 13/658; H01R 13/73

[52] U.S. Cl. ..... 439/108; 439/567; 439/607

[58] Field of Search ..... 439/607, 108, 567, 571–573

[56] References Cited

U.S. PATENT DOCUMENTS

| | | | |
|---|---|---|---|
| 4,718,866 | 1/1988 | Yamaguchi | 439/607 |
| 4,943,244 | 7/1990 | Teck et al. | 439/607 |
| 4,959,626 | 9/1990 | Mouissie | 439/607 |
| 5,104,326 | 4/1992 | Smith et al. | 439/607 |
| 5,125,853 | 6/1992 | Hashiguchi | 439/607 |
| 5,228,873 | 7/1993 | Hirai | 439/573 |

FOREIGN PATENT DOCUMENTS

| | | | |
|---|---|---|---|
| 52388 | 2/1989 | Japan | 439/607 |

*Primary Examiner*—Gary F. Paumen
*Attorney, Agent, or Firm*—Laff, Whitesel, Conte & Saret

[57] ABSTRACT

An electrical connector has an insulator with a base portion, a main surface, and a mating portion formed on the main surface. A pair of blocks are formed at opposite ends of the base portion. Each block has a receiving surface parallel to an installation surface perpendicular to the main surface. The installation surface makes contact with a surface of a printed circuit board when the electrical connector is mounted on the printed circuit board. A plurality of electroconductive contacts are disposed on the mating portion. An electroconductive shell is attached to the base portion for surrounding the mating portion. A pair of flanges are formed at opposite ends of the shell and are received by the receiving surfaces of the blocks. A pair of electroconductive hook lugs are attached to the blocks. A pair of electroconductive holding members are mounted on side surfaces of the blocks and have portions extending in a plane including the installation surfaces. A pair of connecting members electrically connect the hook lugs and flanges. The holding members and side surfaces of the hook lugs are electrically connected.

3 Claims, 7 Drawing Sheets

ELECTRICAL CONNECTOR WITH A SHIELDING SHELL

This application is a division of application Ser. No. 07/911,889, filed Jul. 10, 1992, now abandoned.

BACKGROUND OF THE INVENTION

This invention relates to an electrical connector having a shell for electromagnetic shield and, in particular, to such an electrical connector for use on a printed circuit board having a ground pattern to which the shell is connected.

A conventional electrical connector with a shell generally comprises an insulator and the shell attached to the insulator. The insulator has a base portion, a fitting or mating portion formed on a main surface of the base portion and fitting to, or mating with, a mating connector, and a pair of blocks formed at longitudinal opposite ends of the base portion.

Each of the blocks has an installation surface perpendicular to the main surface. The mating portion is equipped with a plurality of electroconductive contacts.

The shell is made of a metallic plate and fitted onto the mating portion to electromagnetically shield the contacts. The shell comprises a tubular portion for covering or surrounding the mating portion, and a flange radially extending from a peripheral edge of the tubular portion and received by the main surface. The longitudinal opposite ends of the flange extend as flange end portions onto, and received by, receiving surfaces of the blocks. The base portion has a pair of base surfaces at upper and lower sides thereof. Each of the base surfaces is provided with a plurality of projections. A plurality of coupling portions are formed to extend from the flange portion of the shell along the base surfaces for one-to-one engagement with the projections. Each of the coupling portions is formed into a lug having a slot into which the corresponding projection is fitted.

In order to attach the shell to the insulator, the shell is fitted onto the mating portion. In the fitting operation, the coupling portions are firstly brought into contact with the projections and then urged by the projections to be elastically deformed so that the tubular portion is subjected to a force to partially expand the peripheral edge. When the coupling portions are further forced to pass over the projections, the projections are snapped into the slots to make engagement with the coupling portions.

In the meanwhile, the above-mentioned electrical connector with a shell is for use in an electronic apparatus and is required small in size and thin in shape. This is because of a demand for effective utilization of a space in a small-sized apparatus.

However, if the electrical connector with a shell is formed small and thin, the shell is inevitably formed of a metal plate having a reduced thickness. In this situation, the shell is readily deformed when subjected to a force to expand an opening edge of the tubular portion of the shell, for example, in the fitting operation of the shell to the insulator.

The conventional electrical connector with a shell is often used onto a printed circuit board in the prior art.

There are known two types of mounting arrangement for mounting the electrical connector with a shell onto a surface of the printed circuit board.

According to one type, a pair of electroconductive hook lugs are respectively attached to the blocks formed on longitudinal opposite ends of the base portion. Each of the hook lugs is provided with a hook pin. Each hook pin has leg portions adapted to pass through a through hole formed on the printed circuit board. An engagement piece is formed on an end of each leg portion and is protruded from a rear surface of the printed circuit board. The engagement pieces of each hook pin are fixed onto the rear surface of the printed circuit board by means of soldering.

Terminal portions of the contacts pass through the printed circuit board to be connected to a wiring pattern formed on the rear surface of the printed circuit board. The shell is electrical connected to a ground pattern on the rear surface of the printed circuit board through the hook lugs, the hook pins, and screws for mounting the connector onto a panel of an apparatus.

In this type, since the hook pins are bonded by soldering onto the rear surface of the printed circuit board while the electrical connector being mounted on the opposite surface of the printed circuit board, infrared-radiation reflowing can not be used for connecting the hook pins to the ground pattern by soldering.

In another known structure for mounting the conventional electrical connector with a shell, the insulator is positioned on the printed circuit board by means of positioning pins formed at a bottom of the insulator. Each block is provided with a holding member at a side thereof. The holding member is bonded by soldering on the printed circuit board, so that the insulator is fixed to the printed circuit board.

Terminal portions of contacts are for connection with a wiring pattern formed on the top surface of the printed circuit board and extend on, and are bonded to, the wiring pattern by soldering.

In the mounting structure, it is difficult to assure tight contact between the insulator and the printed circuit board. The extending ends of the terminal portions often float up before soldering. This results in non-uniform contact between the top ends of the terminals portions of the contacts and the wiring pattern on the printed circuit board.

As described, it is impossible in the conventional electrical connector with a shell to suppress floating of the top ends of the terminal portions before soldering. As a result, it is difficult to assure reliable connection between the contacts and the wiring pattern on the printed circuit board.

SUMMARY OF THE INVENTION

It is therefore an object of this invention to provide an electrical connector with a shell, which is capable of preventing deformation of the shell of a thin plate and has a sufficient mechanical strength.

It is another object of this invention to provide an electrical connector for connection with a printed circuit board, which can readily perform electrical conduction between the shell and a wiring pattern on the printed circuit board and between the contacts and the wiring pattern on the printed circuit board without floating of contacts.

According to a first feature of this invention, an electrical connector with a shell comprises an insulator having a base portion with a main surface and a mating portion formed on the main surface of the base portion, a plurality of electroconductive contacts formed in the mating portion, an electroconductive shell attached to the base portion for surrounding the mating portion, the base portion having opposite base surfaces perpendicular to the main surface, first engaging means for engaging the base surfaces and the shell with each other, and second engaging means for engaging the base surface and the shell with each other and for suppressing deformation of the shell in the plane of the main surface.

According to this invention, the first engaging means favorably comprises projections formed on the base surfaces, and coupling portions formed on the shell in one-to-one correspondence to the projections and engaged with the projections.

According to this invention, the second engaging means favorably comprises receiving portions formed in the main surface, and projecting portions formed on the shell at positions corresponding to the receiving portions and received in the receiving portions.

According to a second feature of this invention, an electrical connector with a shell comprises an insulator having a base portion with a main surface and a mating portion formed on the main surface of the base portion, a pair of blocks formed at opposite ends of the base portion, each of the blocks having a receiving surface parallel to the main surface and an installation surface perpendicular to the main surface, a plurality of electroconductive contacts disposed in the mating portion, an electroconductive shell attached to the base portion for surrounding the mating portion, a pair of flanges formed at opposite ends of the shell and received by the receiving surfaces of the blocks, a pair of electroconductive hook lugs attached to the blocks, a pair of electroconductive holding members which are mounted on side surfaces of the blocks and extend in parallel to the installation surfaces, a pair of connecting members for electrically connecting the hook lugs and the flanges, and connecting means for electrically connecting the holding members and side surfaces of the hook lugs.

According to this invention, each of the blocks favorably has a groove formed on its side surface for receiving a corresponding one of the holding members. Each of the holding members has a mounting plate to be fitted into the groove, a contact piece formed on the mounting plate for elastic contact with the side surface of the hook lug to serve as the connecting means, and a connecting plate to be connected to a ground pattern on a printed circuit board.

According to this invention, the electrical connector with a shell favorably comprises, as means for fixing the electrical connector onto the printed circuit board, hook pins to be engaged with through holes formed on the printed circuit board. The hook pins are attached to the hook lugs and project from the installation surfaces. The hook pins are provided at their projecting ends with engagement pieces to be engaged with the through holes.

DESCRIPTION OF THE PREFERRED EMBODIMENT

For a better understanding of this invention, description will at first be made as regards a conventional electrical connector with a shell with reference to FIGS. 1 through 5.

Figure 1:
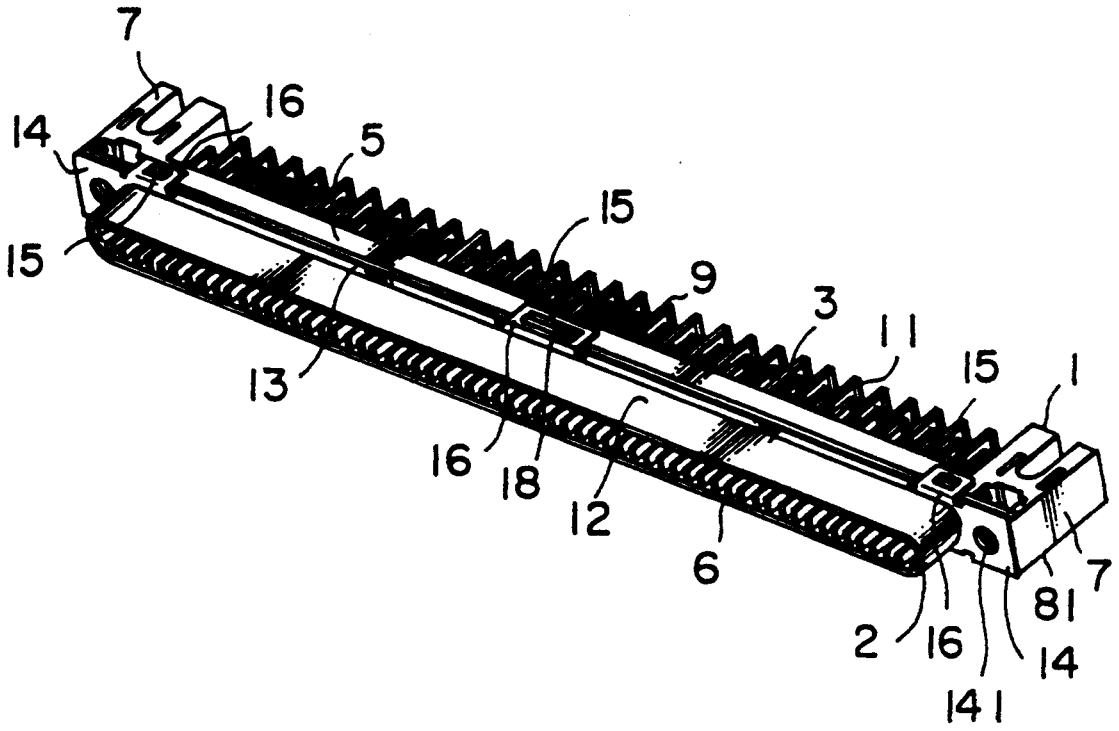
FIG. 1 PRIOR ART
FIG. 1 is a perspective view of a conventional electrical connector with a shell.

Referring to FIG. 1, an electrical connector with a shell generally comprises an insulator 1 and a metallic shell 2 attached to the insulator 1. The insulator 1 comprises a base portion 3 of an elongated plate, a mating portion 6 formed on a main surface (not shown) of the base portion 3, and a pair of blocks 7 formed on longitudinal opposite ends of the base portion 3. Each of the blocks 7 has an installation surface 81 perpendicular to the main surface. The blocks 7 extend in a direction opposite the mating portion 6 with reference to the main surface.

The mating portion 6 is equipped with a plurality of electroconductive contacts 9 arranged in two rows along a longitudinal direction of the base portion 3. Each of the contacts 9 has a contact portion (not shown) disposed in the mating portion 6, an intermediate portion held by the base portion 3, and a terminal portion 11 outwardly extending from a rear side of the main surface.

The shell 2 is formed of a metallic plate and has a tubular portion 12 for surrounding the mating portion 6 and a flange 13 radially extending from a peripheral edge of the tubular portion 12 and being received by the main surface. The flange 13 has a pair of flange end portions 14 formed at opposite ends of the flange 13 to extend onto, and received by, receiving surfaces of the blocks 7. Each of the flange end portions 14 is provided with an insertion hole 141.

The base portion 3 has an upper and a lower surface as a pair of base surfaces 5. An engaging arrangement is formed on each of the base surfaces 5 and on the flange 13 of the shell 2 for mutual engagement thereof. More specifically, the engaging arrangement comprises three projections 15 formed on each base surface 5. The flange 13 of the shell 2 is provided with six coupling portions 16 (three of them are viewed in FIG. 1) in one-to-one correspondence to the three projections 15 on each base surface 5. Each of the coupling portions 16 is provided with a slot 18 for receiving and engaging the corresponding projection 15.

In order to assemble the shell 2 to the insulator 1, the shell 2 is fitted onto and pushed to the mating portion 6. In the operation, the coupling portions 16 are firstly brought into contact with the projections 15 and then urged by the projections 15 to be elastically deformed. When the coupling portions 16 are further forced to pass over the projections 15, the projections 15 snap fit into the slots 18 to make engagement with the coupling portions 16.

As already described, the shell 2 is subjected to a force to expand an opening edge of the tubular portion 12.

Referring to FIGS. 2 through 5, two types of the conventional electrical connectors with a shell will be described which are to be surface-mounted on a printed circuit board 22. Although these electrical connectors comprises components different in size from the electrical connector with a shell shown in FIG. 1, an insulator 1 and a shell 2 are similar in structure to those described in conjunction with FIG. 1. In this connection, the similar parts are designated by like reference numerals and the description of the structure will partially be omitted.

Figure 2:
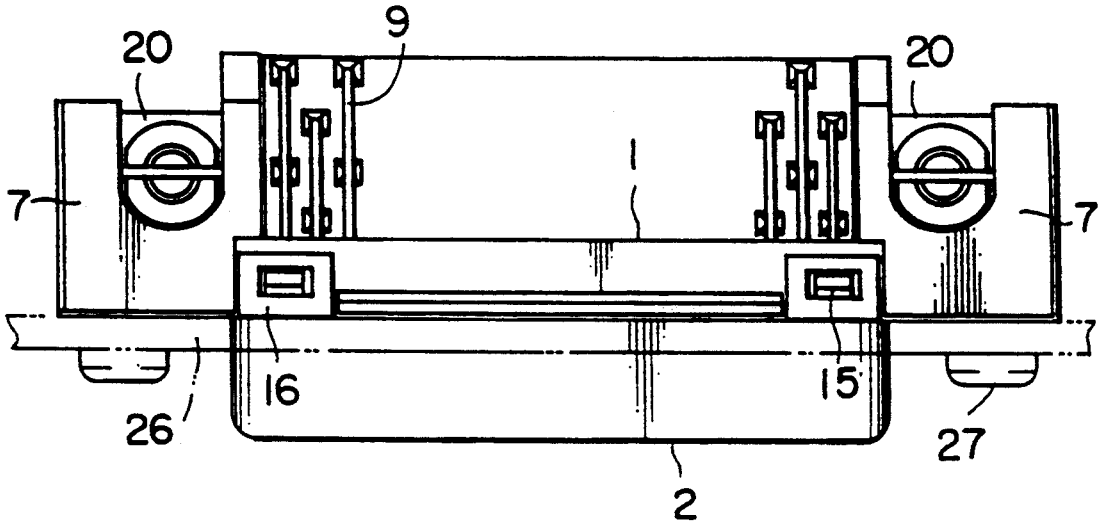
FIG. 2 PRIOR ART
FIG. 2 is a plan view of another conventional electrical connector with a shell.
Figure 3:
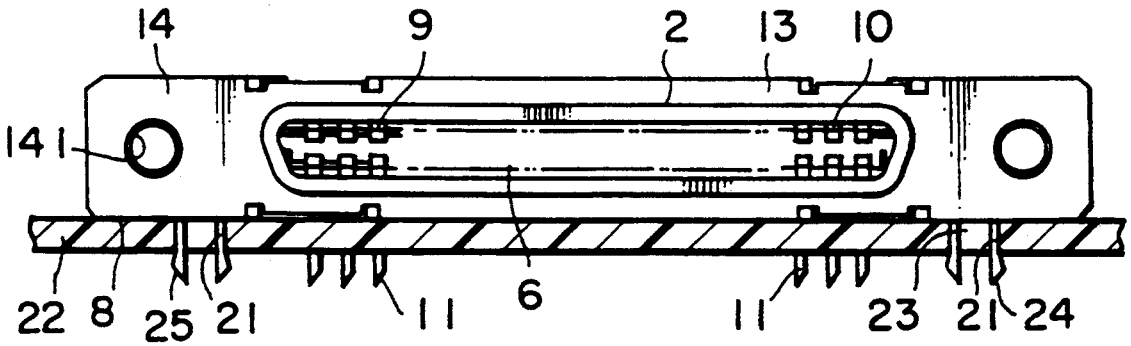
FIG. 3 PRIOR ART
FIG. 3 is a front view of the conventional electrical connector with a shell in FIG. 2 when it is mounted on a printed circuit board.

Referring to FIGS. 2 and 3, one type of the electrical connector has a pair of hook lugs 20 attached to the blocks 7, respectively. Each of the hook lugs 20 is provided with a hook pin 21. Each hook pin 21 are made to pass through a corresponding one of through holes 23 formed on the printed circuit board 22 to be engaged with a rear surface of the printed circuit board 22. More specifically, each hook pin 21 has a pair of leg portions 24. An engagement piece 25 is formed on an end of each of the leg portions 24. The engagement pieces 25 of the hook pins 21 are fixed to a ground pattern on the rear surface of the printed circuit board 22 by means of soldering. Thus, the electrical connector is fixed onto the printed circuit board 22.

Contact portions 10 of contacts 9 are brought into contact with mating contacts of a mating connector (not shown). Terminal portions 11 of the contacts 9 pass through the printed circuit board 22 to be connected to a wiring pattern formed on the rear surface of the printed circuit board 22.

The electrical connector may be fixed to a panel 26 by means of screws 27 received in the screw holes 141 in the flange end portions 14 of the shell 2. The screws 27 is also connected to the hook lugs 20. Therefore, the shell 2 and the ground pattern are electrically connected through the screws 27, the hook lugs 20, and the hook pins 21.

In the electrical connector as shown in FIGS. 2 and 3, the hook pins 21 are bonded by soldering onto the rear surface of the printed circuit board 22. On the other hand, a body of the electrical connector is mounted on the opposite surface of the printed circuit board 22. Accordingly, when creamy solder is put on the printed circuit board 22 and is subjected to soldering, infrared-radiation reflowing can not be used.

Figure 4:
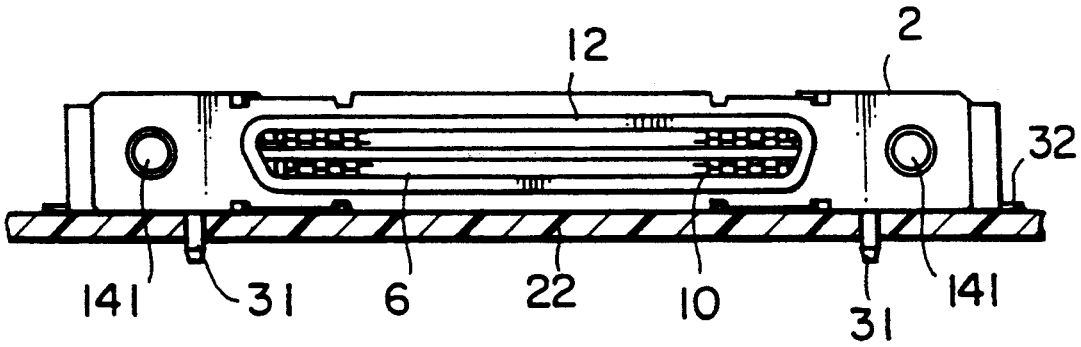
FIG.4 PRIOR ART
FIG. 4 is a front view of a yet another conventional electrical connector with a shell.
Figure 5:
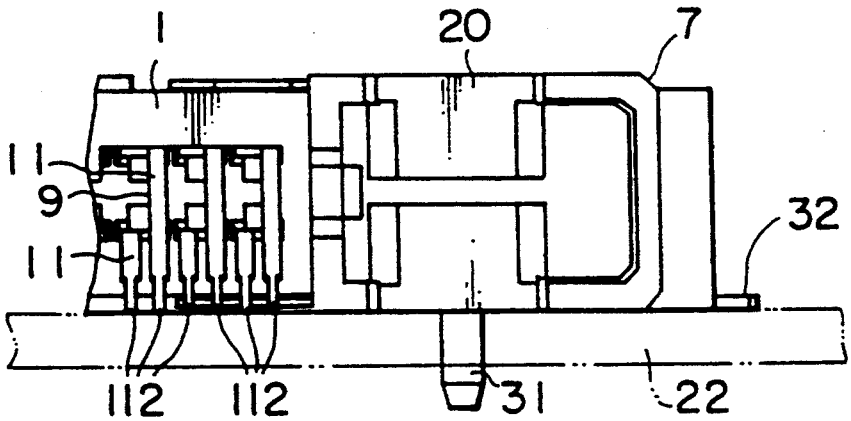
FIG.5 PRIOR ART
FIG. 5 is an enlarged rear view of a part of the conventional electrical connector with a shell in FIG. 4.

Referring to FIGS. 4 and 5, in another type of the conventional electrical connector, the insulator 1 is positioned on a printed circuit board 22 by means of positioning pins 31 formed at a bottom of the insulator 1. Each of blocks 7 is provided with a holding member 32 at a side thereof. The holding member 32 is bonded to a ground pattern on the printed circuit board 22 by means of soldering. Thus, the electrical connector is fixed onto the printed circuit board 22. The terminal portions 11 of contacts 9 extend over the printed circuit board 22, and extending ends 112 of terminal portions 11 are kept at a level flush with a top surface of the printed circuit board 22, or slightly higher than the top surface of the printed circuit board 22. Herein, the contact portions 10 are socket portions to be brought into contact with mating contacts while the terminal portions 11 are bonded by soldering to a wiring pattern formed on the top surface of the printed circuit board 22.

In the electrical connector in FIGS. 4 and 5 using the holding member 32 for fixing the insulator 1 onto the printed circuit board 22, it is difficult to assure tight contact between the insulator 1 and the printed circuit board 22. Accordingly, the extending ends 112 of the terminal portions 11 often float up over the wiring pattern of the printed circuit board 22 before soldering. This results in non-uniform contact between the extending ends 112 of the terminal portions 11 and the wiring pattern on the printed circuit board 22.

Figure 6:
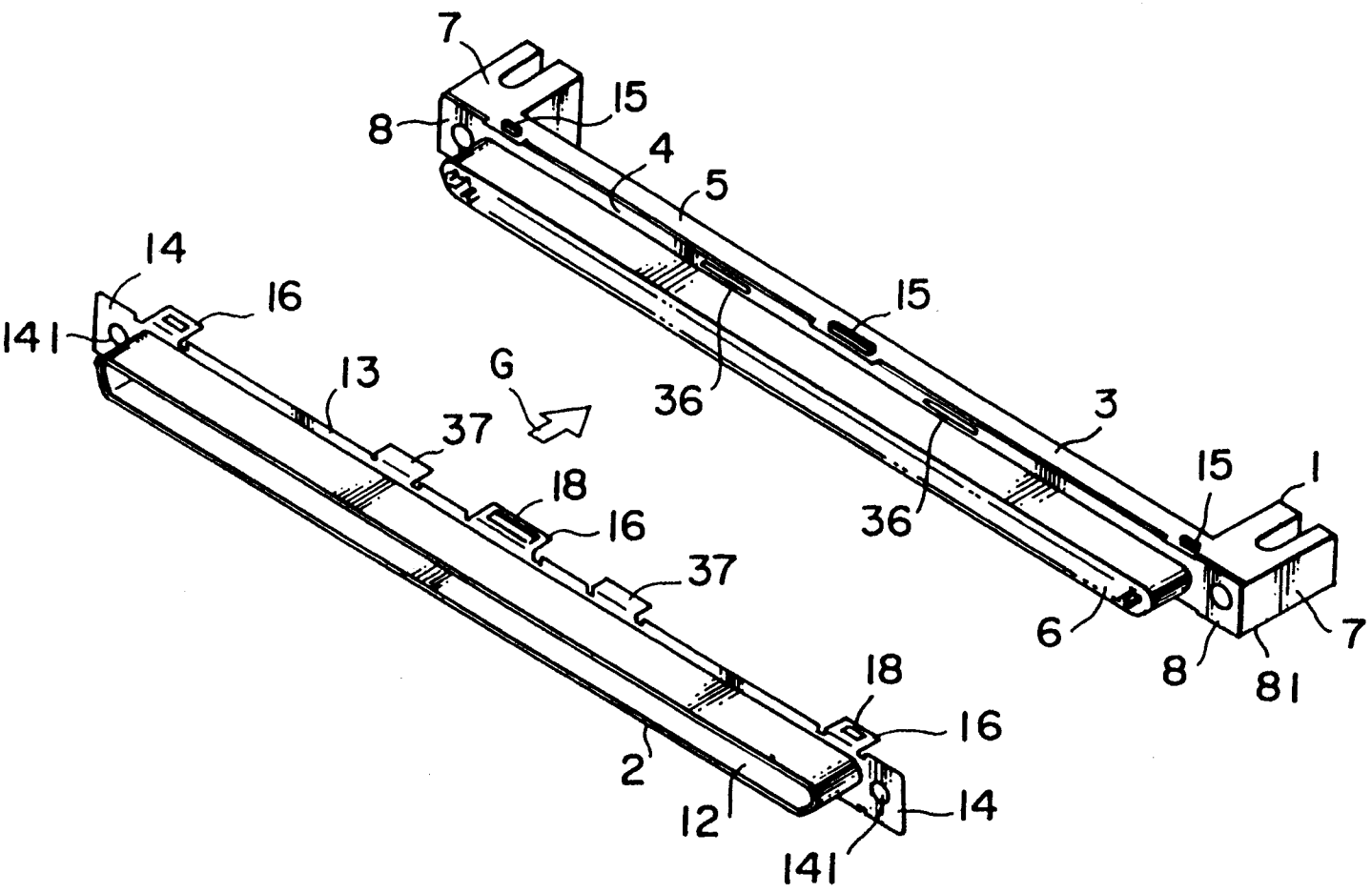
FIG. 6 is an exploded perspective view of an electrical connector with a shell according to a first embodiment of this invention.
Figure 7:
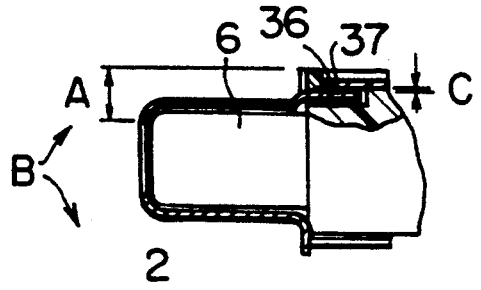
FIG. 7 is a sectional view of the electrical connector with a shell in FIG. 6 when it is assembled together.
Figure 8:
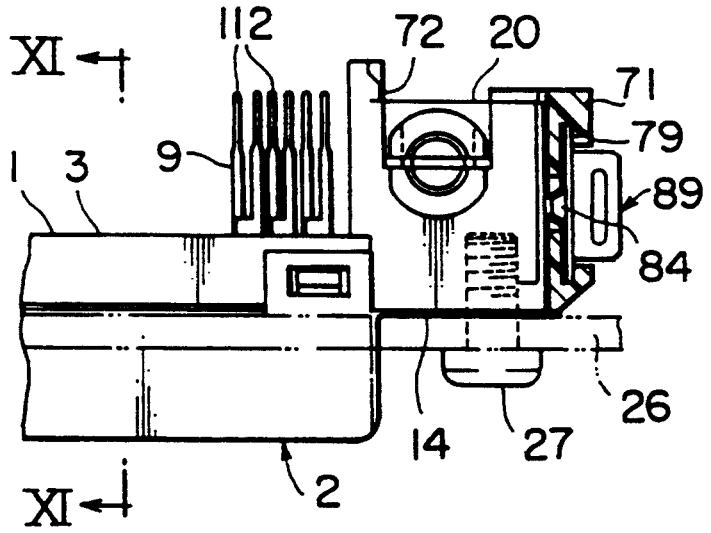
FIG. 8 is a plan view showing a main portion of an electrical connector with a shell according to a second embodiment of this invention.

Referring to FIGS. 6 and 7, description will now be made as regards an electrical connector with a shell according to a first embodiment of this invention. In the first embodiment, the similar parts are designated by like reference numerals as described in conjunction with FIG. 1.

The electrical connector comprises an insulator 1 and an electroconductive metallic shell 2 attached to the insulator 1. The insulator 1 comprises a base portion 3 of an elongated plate. The base portion 3 has a main surface 4 and a pair of base surfaces 5 which are an upper and a lower surface perpendicular to the main surface 4. A mating portion 6 is formed on the main surface 4 of the base portion 3. A pair of blocks 7 are respectively formed on longitudinal opposite ends of the base portion 3. Each of the blocks 7 has a receiving surface 8 parallel to the main surface 4 and an installation surface 81 perpendicular to the main surface 4. Installation surface 81 is brought into contact with a surface of printed circuit board 22 when the electrical connector is mounted on the printed circuit board 22. The blocks 7 extend in a direction opposite the mating portion 6 with reference to the main surface 4. The mating portion 6 is provided with a plurality of electroconductive contacts 9 (see FIG. 1) arranged in two rows along a longitudinal direction of the base portion 3. Each of the contacts 9 has a contact portion 10 (see FIG. 4) disposed in the mating portion 6, an intermediate portion held by the base portion 3, and a terminal portion 11 (see FIG. 1) outwardly extending from a rear side of the base portion 3.

The shell 2 is formed of a metallic plate and has a tubular portion 12 for covering and surrounding the mating portion 6, and a flange 13 radially extending from a peripheral edge of the tubular portion 12 and being received by the main surface 4. The flange 13 has flange end portions 14 extending from opposite ends of the flange 13 onto the receiving surfaces 8.

A first engaging arrangement is formed on the base surfaces 5 and on the shell 2 for mutual engagement thereof. More specifically, the first engaging arrangement comprises three projections 15 formed on one of the base surfaces 5. The three projections 15 are respectively located at longitudinal opposite ends of the base surface 5 and an intermediate portion therebetween.

Three projections are formed on the other of the base surfaces 5 in the similar form. The flange portion 13 of the shell 2 is provided with six coupling portions 16 (three of them are shown) in one-to-one correspondence to the six projections 15. Each of the coupling portions 16 is provided with a slot 18 for receiving the corresponding projection 15.

A second engaging arrangement is formed on the main surface 4 and on the shell 2 for mutual connection therebetween and for suppression of deformation of the shell 2 in the plane on the main surface 4. The second engaging arrangement comprises four receiving portions 36 (two of them are viewed in FIG. 6) formed in the main surface 4, and four projecting portions 37 (two of them are viewed in FIG. 6) formed on the flange 13 at positions corresponding to the receiving portions 36. The projecting portions 37 are received in the receiving portions 36. In FIG. 6, each of the receiving portions 36 is a rectangular slit. Two of the receiving portions 36 are located on the main surface 4 at both sides of the intermediate projection 15 formed on one of the base surfaces 5. The other of the receiving portions 36 are also located on the main surface 4 at both sides of the intermediate projection formed on the other of the base surfaces 5.

In order to assemble the shell 2 to the insulator 1, the shell 2 is fitted onto the mating portion 6 in a direction depicted by an arrow G in FIG. 6. In the fitting operation, the coupling portions 16 are brought into contact with the projections 15 and then urged by the projections 15 to be elastically deformed in the plane on the main surface 4. When the coupling portions 16 are further forced to pass over the projections 15, the projections 15 are snap fitted into the slots 18. Simultaneously, the projecting portions 37 are received in and engaged with the receiving portions 36. Therefore, the tubular portion 12 is suppressed from deformation or expansion due to, for example, deformation of the coupling portions.

The illustrated electrical connector is a receptacle connector and the mating portion 6 is inserted inside the shell 2. Accordingly, inward deformation of the shell 2 is suppressed by the mating portion 6. On the other hand, the receiving portions 36 serve particularly to suppress outward expansion of the shell 2 as depicted by an arrow B in FIG. 7. A distance C between the projecting portion 37 and the receiving portion 36 is selected to be substantially small.

In application of the second engaging arrangement onto a plug connector, both outward and inward deformation of the shell can be restricted Each receiving portion 36 may be a groove instead of the rectangular slit inasmuch as the receiving portion 36 can suppress deformation of the shell 2.

The projecting portions 37 may be connected not to the flange 13 but to a peripheral edge of the tubular portion 12 and inserted into the receiving portions 36.

According to the electrical connector of FIGS. 6 and 7, the deformation of the shell 2 is suppressed even if the shell 2 is subjected to an external force. As a result, the electrical connector can be formed in a thin shape with a sufficient mechanical strength.

FIGS. 8 through 16 show an electrical connector according to a second embodiment of this invention. Although this electrical connector comprises components different in size from the electrical connector with a shell shown in FIG. 6, an insulator 1 and a shell 2 are similar in structure to those described in conjunction with FIG. 6. In this connection, the similar parts are designated by like reference numerals and the description of the structure will partially be omitted.

Figure 15:
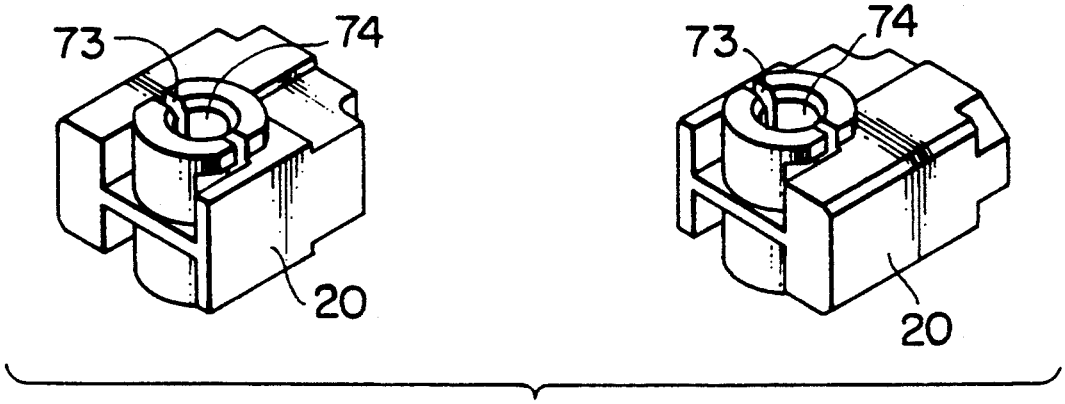
FIG. 15 is a perspective view of hook lugs respectively attached to a pair of blocks of the electrical connector with a shell in FIG. 8.

Referring to FIGS. 8 through 14, the electrical connector with a shell has a pair of blocks 71 formed at opposite sides of a base portion 3. Each of the blocks 71 is provided with an electroconductive hook lug 20 which is also shown in FIG. 15. A large receiving hole 72 is formed in each block 71 for insertion of the hook lug 20. On a side surface of each block 71 is mounted an electroconductive holding member 89 which is in electrical contact with the hook lug 20.

Each holding member 89 is located on the printed circuit board has portions extending in a plane including the installation surface 81. 22.

Figure 12:
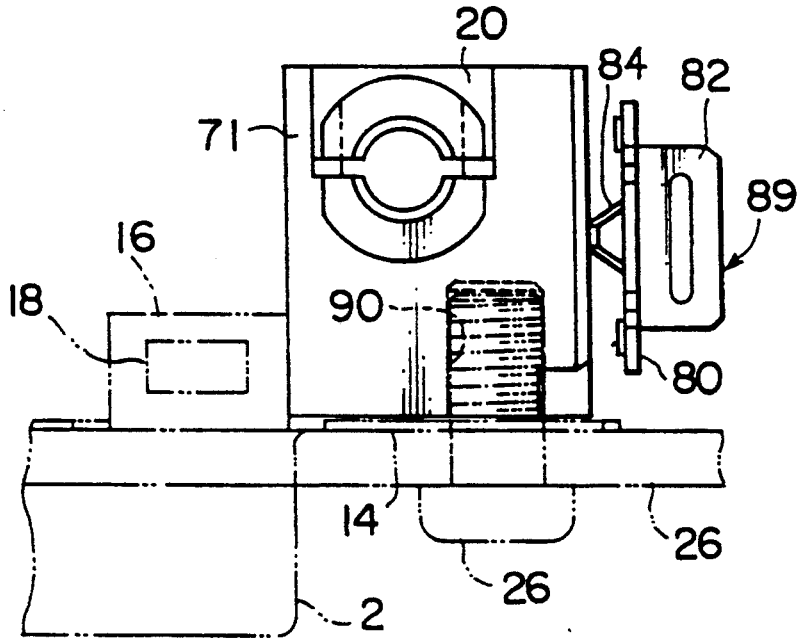
FIG. 12 is a plan view for describing a contact state between a hook lug and a holding member in FIG. 8 in detail.
Figure 13:
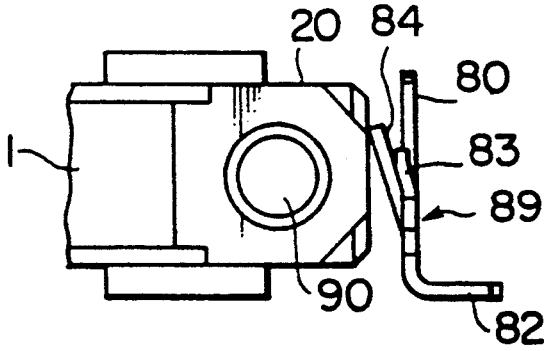
FIG. 13 a front view of the contact state in FIG. 12.
Figure 14:
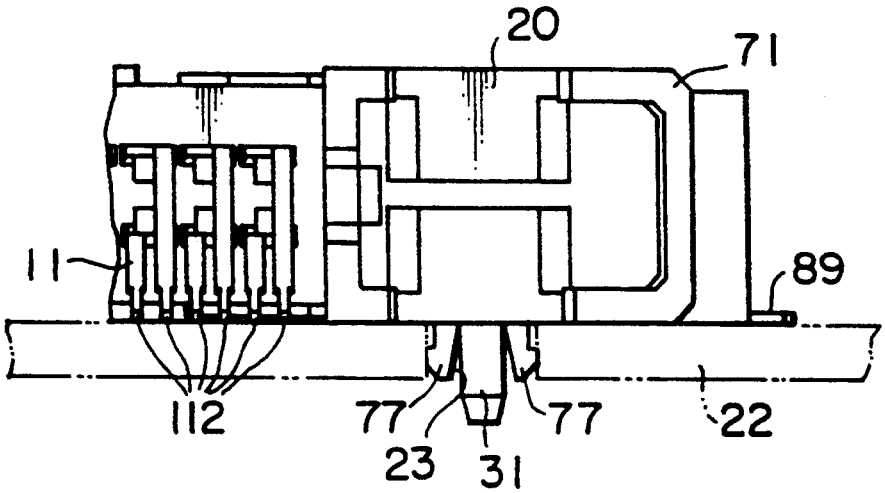
FIG. 14 is an enlarged rear view of a part of the electrical connector with a shell in FIG. 8.

As shown in FIGS. 12 and 13, each hook lug 20 is provided with a screw hole 90 facing the insertion hole 141 of the flange end portion 14. The hook lug 20 and the flange end portion 14 of the shell 2 are electrically connected to each other through the screw 27 which is threaded in the screw hole 90 through the insertion hole 141 so as to mount the connector onto the panel 26 of an apparatus.

Each hook lug 20 is provided with a hook pin 21 which is engaged therewith and which is to be engaged with a through hole 23 formed in the printed circuit board 22. A holding groove 73 is formed on an installation surface 81 of each hook lug 20 to receive and hold a head of the hook pin 21. A penetrating hole 74 is formed in each hook lug 20 to penetrate therethrough from one surface to the opposite surface of the hook lug 20. Although not shown in the figure, a bolt may be inserted through the penetrating hole 74 so as to fix the insulator 1 to the printed circuit board 22. The two hook lugs 20 have a similar shape and mounted in the receiving holes 72 of the left and the right blocks 71 to be symmetrical with each other.

Figure 9:
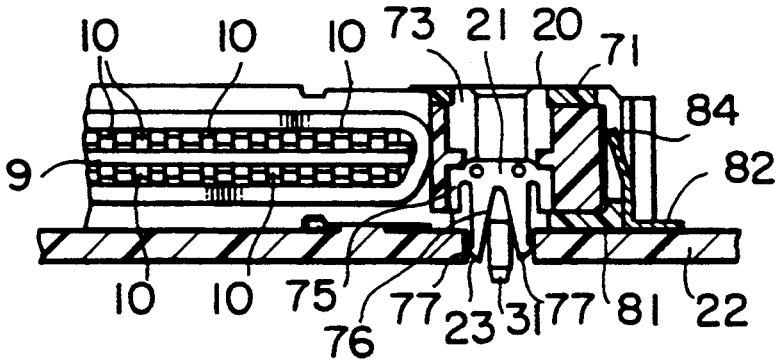
FIG. 9 is a front view of the electrical connector with a shell in FIG. 8.
Figure 10:
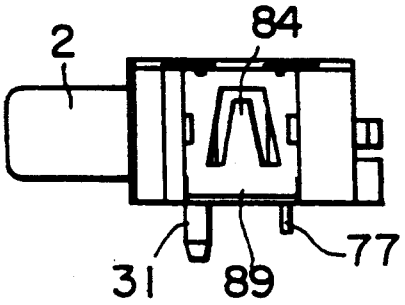
FIG. 10 is a side view of the electrical connector with a shell in FIG. 8.
Figure 11:
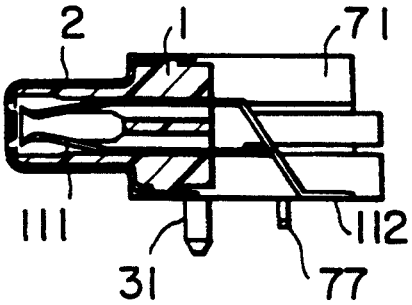
FIG. 11 is a sectional view of the electrical connector with a shell taken along a line XI—XI in FIG. 8.

As shown in FIG. 9, each hook pin 21 has a pair of engagement pieces 75 at a head portion thereof. Inside these engagement pieces 75, a pair of leg portions 76 downwardly extend to project from a bottom surface of the insulator 1. A pair of engagement projections 77 are respectively formed at extending ends of a pair of the leg portions 76.

Figure 16:
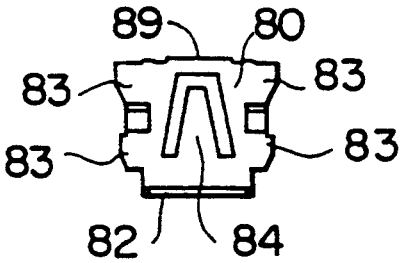
FIG. 16 is a side view of a holding member used in the electrical connector with a shell in FIG. 8.

A groove 79 is formed in a side surface of each block 71 to receive the holding member 89. As shown in FIG. 16, each holding member 89 comprises, in an integral fashion, a mounting plate 80 pressed into and fitted in the groove 79, a contact piece 84 formed by cutting and bending a center portion of the mounting plate 80 and elastically connected to the hook lug 20, and an installation plate 82 which extends in a plane including the installation surfaces 81 and which is brought into contact with the ground pattern on the printed circuit board 22. A plurality of mounting pieces 83 are formed at both ends of each mounting plate 80 and elastically pressed into the groove 79 of the block 71. An inner end of the contact piece 84 is brought into press contact with a side surface of the hook lug 20 as illustrated in FIGS. 12 and 13 in detail.

When the electrical connector in FIG. 9 is mounted on the printed circuit board 22, positioning pins 31 formed at a bottom of the insulator 1 are inserted into positioning holes (not shown) formed on the printed circuit board 22. Thus, the insulator 1 is positioned on the printed circuit board 22. The pair of engagement projections 77 of the hook pin 21 are inserted into the through hole 23 formed on the printed circuit board 22 and engaged with an inner wall of the through hole 23. Thus, the electrical connector is tightly fixed to the printed circuit board 22. In other words, the electrical connector is formed by the hook pin 21 to be pressed against the printed circuit board 22 together with contacts 9. Accordingly, the contacts 9 are prevented from vertically swinging or floating over the printed circuit board 22. As a result, the extending ends 112 of terminal portions 11 are reliably and uniformly brought into tight contact with the wiring pattern on the printed circuit board 22. Simultaneously, each holding member 89 is brought into tight contact with the ground pattern on the printed circuit board 22. In this state, creamy solder is put on the printed circuit board 22 and is subjected to soldering in a suitable manner. Thus, the contacts 9 and the installation plates 82 of the holding members 89 are respectively connected to the corresponding wiring and ground patterns by soldering.

When each holding member 89 is bonded by soldering to the ground pattern on the printed circuit board 22, the ground pattern and the shell 2 are mutually electrically connected through a path formed by the contact piece 84, the hook lug 20, and the screw 27. In this event, a ground signal is directed through the above-mentioned path finally to the ground pattern on the printed circuit board 22. Due to presence of the contact piece 84 formed on the holding member 89, the shell 2 and the ground pattern on the printed circuit board 22 are readily connected through the contact piece 84 and the holding member 89.

By the use of the hook pin 21, the electrical connector is forced by the hook pin 21 coupled to the through hole 23 to be tightly attached onto the printed circuit board 22 with a sufficient holding force. Accordingly, the extending ends 112 of the terminal portions 11 are prevented from floating up from the printed circuit board 22. As a result, it is possible to reliably and tightly connect the contacts 9 to the wiring pattern on the printed circuit board 22 by successful soldering.

What is claimed is:

1. An electrical connector, comprising an insulator having a base portion with a main surface and a mating portion formed on said main surface of said base portion, a pair of blocks formed at opposite ends of said base portion, each of said blocks having a receiving surface parallel to said main surface and an installation surface perpendicular to said main surface, said installation surface making contact with a surface of a printed circuit board when said electrical connector is mounted on the printed circuit board, a plurality of electroconductive contacts disposed on said mating portion, an electroconductive shell attached to said base portion for surrounding said mating portion, a pair of flanges formed at opposite ends of said shell and received by said receiving surfaces of said blocks, a pair of electroconductive hook lugs attached to said blocks, a pair of electroconductive holding members which are mounted on side surfaces of said blocks and which have portions extending in a plane including said installation surfaces, a pair of connecting members for electrically connecting said hook lugs and said flanges, and connecting means for electrically connecting said holding members and side surfaces of said hook lugs.

2. An electrical connector with a shell according to claim 1, wherein each of said blocks has a groove formed on its side surface for receiving a corresponding one of said holding members, each of said holding members having a mounting plate to be fitted into said groove, a contact piece formed on said mounting plate for elastic contact with said side surface of said hook lug to serve as said connecting means, and a connecting plate to be connected to a ground pattern on said printed circuit board.

3. An electrical connector with a shell according to claim 1, further comprising, as means for fixing said electrical connector onto said printed circuit board, hook pins to be engaged with through holes formed on said printed circuit board, said hook pins being in engagement with said hook lugs and projecting from said installation surfaces, said hook lugs being provided at their projecting ends with engagement projections to be engaged with said through holes.

* * * * *